US012680781B2

(12) United States Patent
Peng

(10) Patent No.: US 12,680,781 B2
(45) Date of Patent: Jul. 14, 2026

(54) MODULAR BULLPUP FIREARM

(71) Applicant: Atlas Engineering LLC, Sheridan, WY (US)

(72) Inventor: Daniel Peng, Dallas, TX (US)

(73) Assignee: Atlas Engineering LLC, Sheridan, WY (US)

( * ) Notice: Subject to any disclaimer, the term of this patent is extended or adjusted under 35 U.S.C. 154(b) by 0 days.

(21) Appl. No.: 19/275,241

(22) Filed: Jul. 21, 2025

(65) Prior Publication Data

US 2026/0139923 A1 May 21, 2026

Related U.S. Application Data

(63) Continuation-in-part of application No. 18/952,059, filed on Nov. 19, 2024, now abandoned.

(51) Int. Cl.

| | |
|---|---|
| ***F41A 3/72*** | (2006.01) |
| ***F41A 3/66*** | (2006.01) |
| ***F41A 11/02*** | (2006.01) |
| ***F41A 35/06*** | (2006.01) |
| ***F41C 7/00*** | (2006.01) |

(52) U.S. Cl.

CPC ..... *F41C 7/00* (2013.01); *F41A 3/66* (2013.01); *F41A 3/72* (2013.01); *F41A 11/02* (2013.01); *F41A 35/06* (2013.01)

(58) Field of Classification Search

CPC .. F41A 11/00; F41A 11/02; F41A 3/66; F41A 3/72; F41A 17/38; F41A 17/52; F41A 19/08; F41A 19/02; F41A 35/06; F41C 7/00

See application file for complete search history.

(56) References Cited

U.S. PATENT DOCUMENTS

| | | | | |
|---|---|---|---|---|
| 2,882,635 A * | 4/1959 | Hill | F41A 9/12 | 89/33.17 |
| 4,562,659 A * | 1/1986 | Neta | F41A 35/06 | 42/71.01 |
| 4,905,394 A * | 3/1990 | Predazzer | F41A 9/65 | 42/17 |
| 8,782,940 B1 * | 7/2014 | Morris | F41C 23/20 | 42/71.01 |
| 8,806,788 B1 * | 8/2014 | Hu | F41A 17/38 | 42/6 |

(Continued)

OTHER PUBLICATIONS

International Searching Authority, International Search Report and Written Opinion issued in corresponding PCT Application No. PCT/US2025/054902, Mar. 17, 2026.

*Primary Examiner* — Joshua E Freeman
(74) *Attorney, Agent, or Firm* — Wood Herron & Evans LLP

(57) ABSTRACT

Provided is a downward ejecting bullpup firearm with a detachable magazine having a downward facing ejection port rearward of a magazine well. A top inspection window is positioned substantially in vertical alignment with the magazine well. A charging handle body has a rear portion and a forward portion and is movable between forward and rearward positions. The rearward portion blocks the inspection window when the charging handle body is in the forward position and the forward portion has a through-opening that substantially aligns with the inspection window when the charging handle body is in the rearward position.

6 Claims, 20 Drawing Sheets

(56) References Cited

U.S. PATENT DOCUMENTS

| | | | | |
|---|---|---|---|---|
| 8,819,976 | B1 * | 9/2014 | Kellgren | F41A 9/17 42/6 |
| 8,931,393 | B1 * | 1/2015 | Vincent | F41A 17/46 89/27.3 |
| 8,944,041 | B2 * | 2/2015 | Hu | F41A 19/06 89/129.01 |
| 9,021,935 | B1 * | 5/2015 | Kellgren | F41A 7/00 89/193 |
| 9,115,954 | B1 * | 8/2015 | Corsi | F41A 19/06 |
| 10,345,074 | B1 * | 7/2019 | Zamlinskiy | F41C 23/10 |
| 10,401,103 | B2 * | 9/2019 | Konev | F41A 17/38 |
| 11,035,636 | B2 * | 6/2021 | Muska | F41C 7/02 |
| 2014/0013640 | A1 * | 1/2014 | Munson | F41A 17/38 42/6 |
| 2014/0360076 | A1 * | 12/2014 | Zamlinsky | F41C 23/20 42/75.03 |
| 2015/0316339 | A1 * | 11/2015 | Young | F41A 35/06 42/49.01 |
| 2015/0338181 | A1 * | 11/2015 | McAlister | F41A 19/09 29/525.08 |
| 2017/0167812 | A1 * | 6/2017 | Shaver | F41A 11/02 |
| 2018/0195822 | A1 * | 7/2018 | Jonsson | F41A 3/66 |
| 2020/0309477 | A1 * | 10/2020 | Bennink | F41A 9/32 |
| 2024/0077263 | A1 * | 3/2024 | Douvier | F41A 19/09 |

* cited by examiner

MODULAR BULLPUP FIREARM

RELATED APPLICATIONS

This application is a continuation-in-part of U.S. patent application Ser. No. 18/952,059 filed Nov. 19, 2024, and U.S. patent application Ser. No. 18/952,169 filed Nov. 19, 2024, the entirety of which are incorporated herein by reference.

TECHNICAL FIELD

This invention relates to a modular rifle system in a bullpup configuration.

BACKGROUND

A "bullpup" firearm is one with its grip and fire control located in front of the breech of the weapon instead of behind it. This creates a weapon with a shorter overall length for a given barrel length but creates certain challenges in design for interconnecting controls that need to be accessible to the user's trigger hand and the mechanism being controlled.

In a modular firearm design, modules that include operation controls or controlled parts need to be interchangeable with a standardized connection therebetween.

SUMMARY OF THE INVENTION

The present invention provides a bullpup configuration weapon system with features that can be combined in a variety of ways and that allows modularity of certain features.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1A:
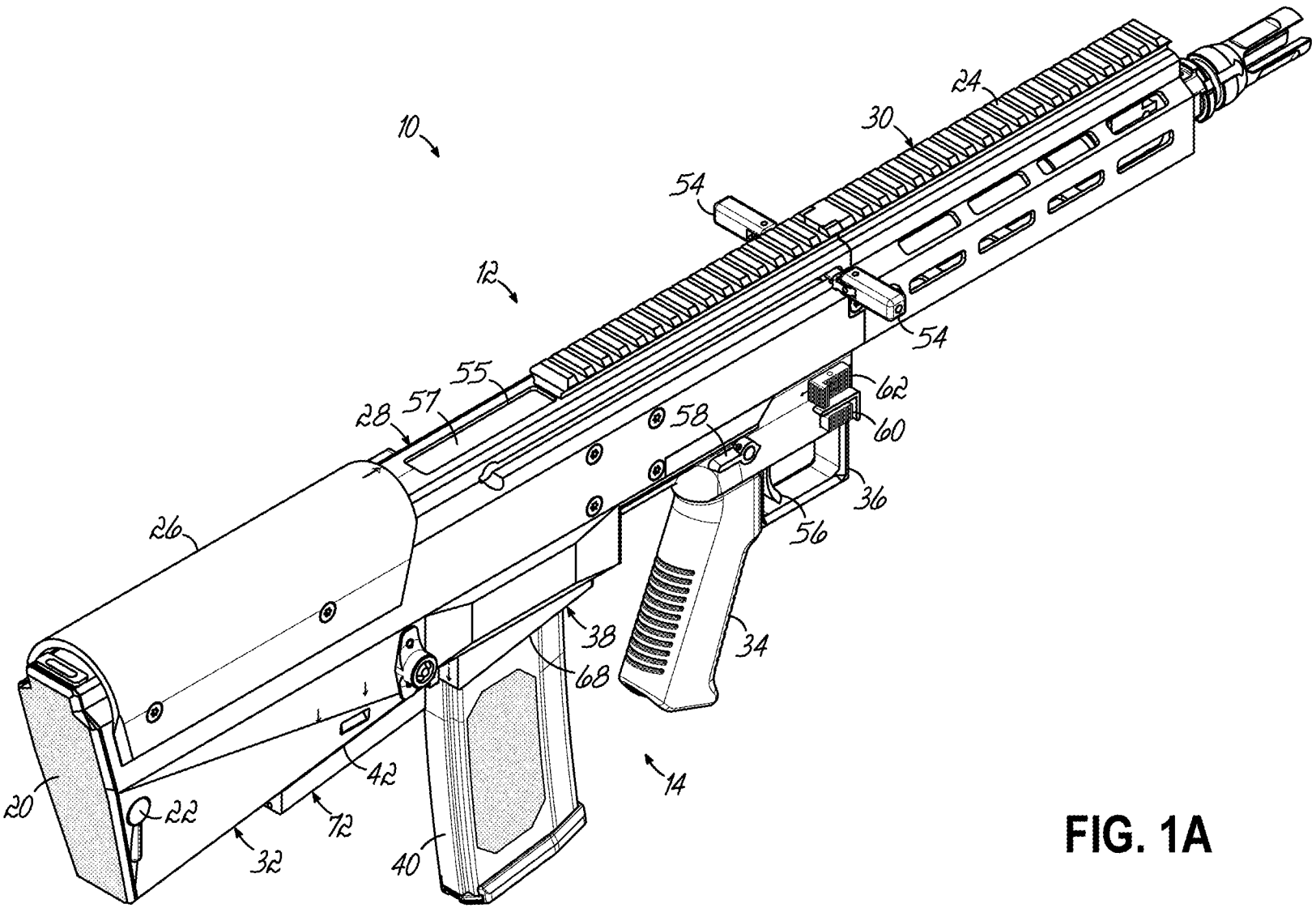
FIG. 1A is a first isometric view of a rifle according an embodiment of the invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 1B:
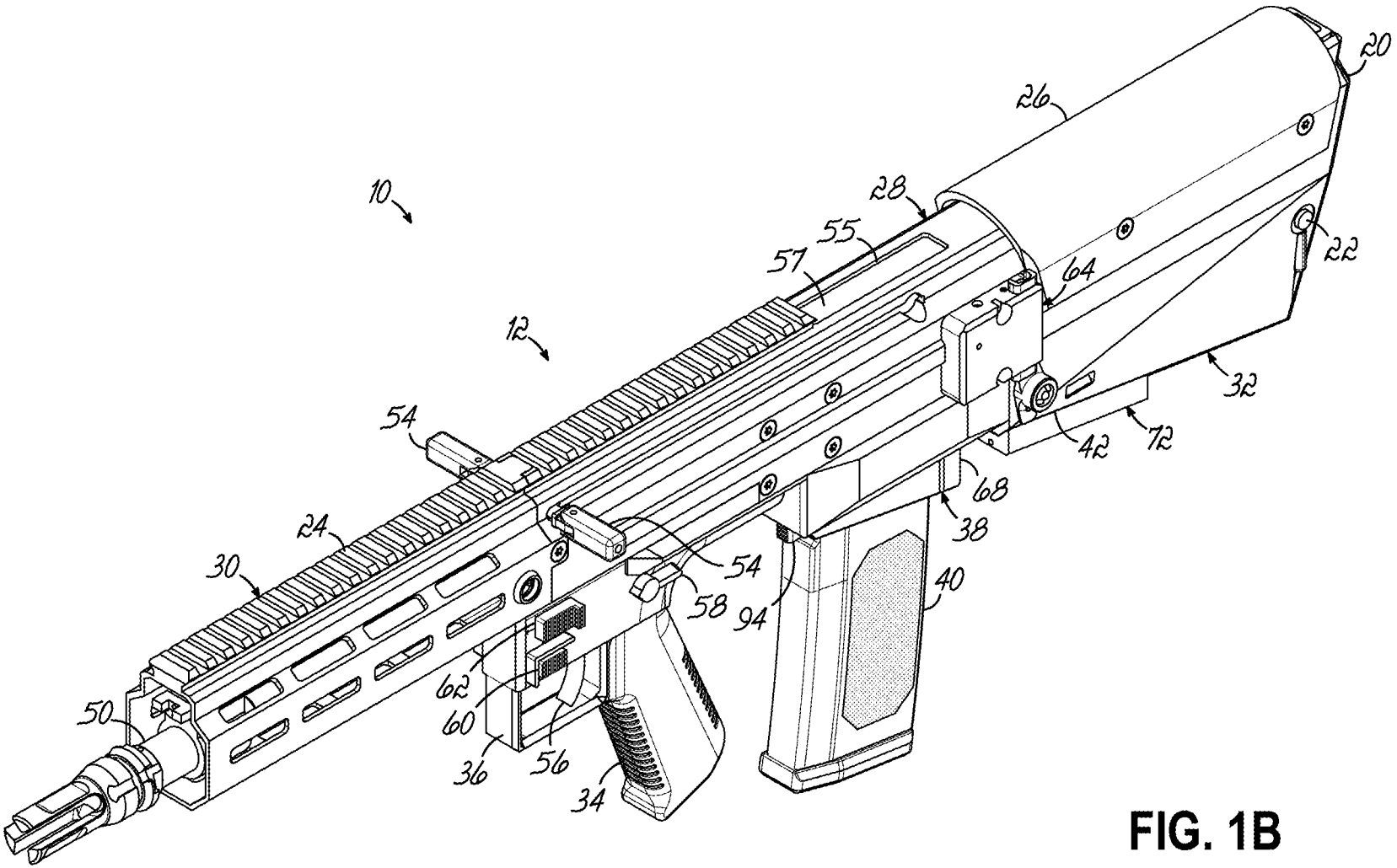
FIG. 1B is an opposite isometric view thereof.
Figure 2:
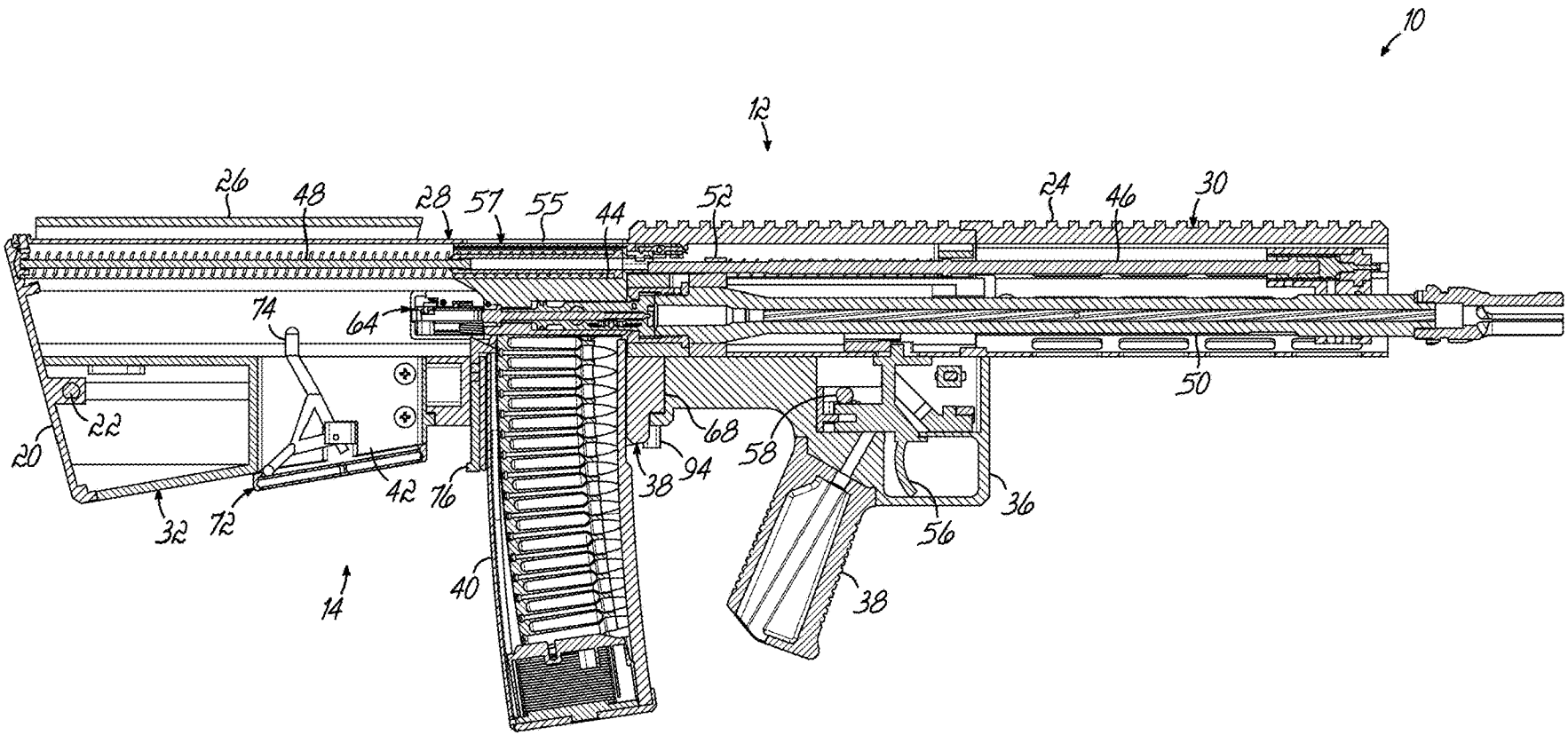
FIG. 2 is a side longitudinally sectioned view thereof showing some of the internal structure and features.
Figure 3:
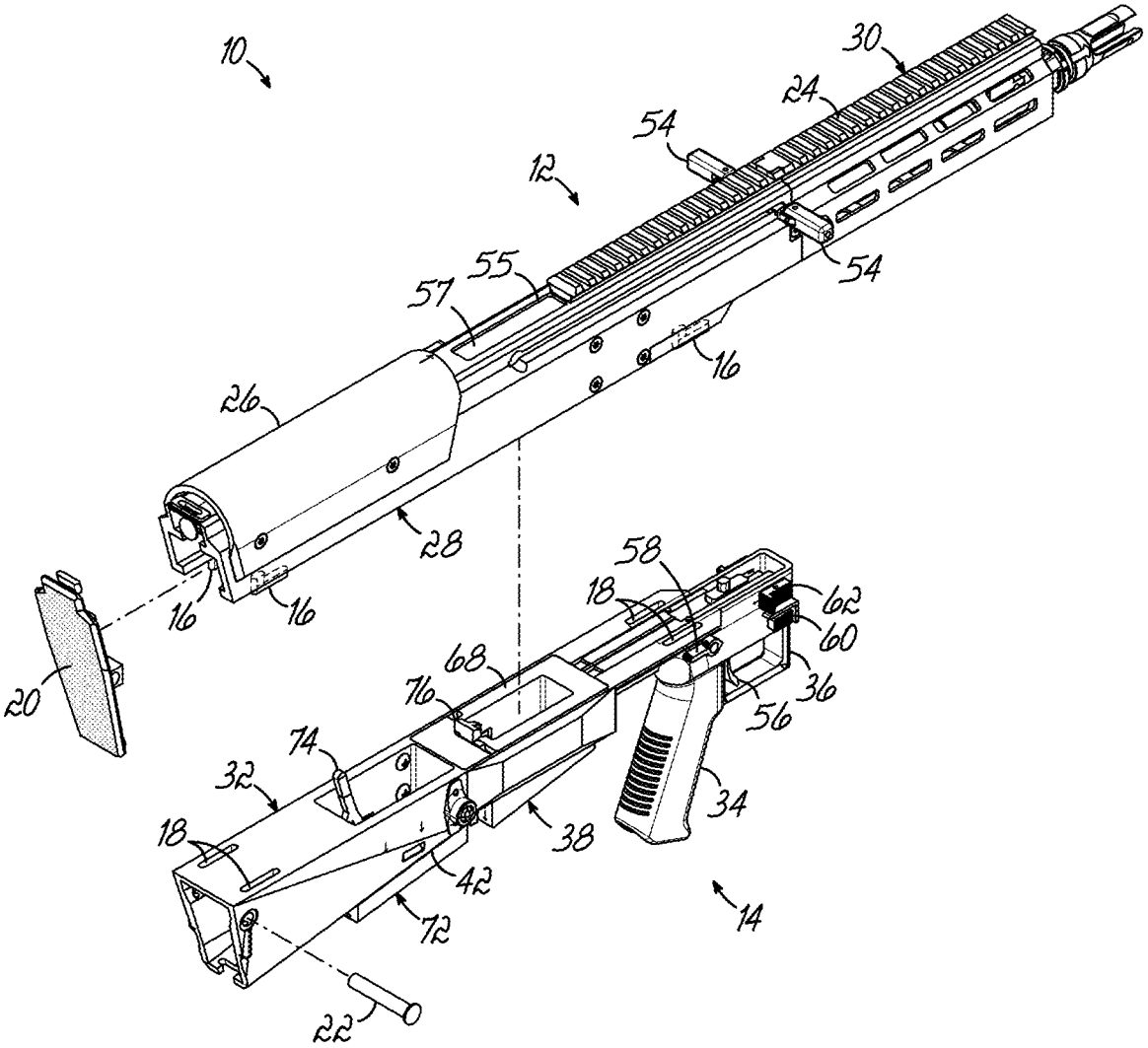
FIG. 3 is a partially disassembled isometric view thereof.

Referring first to FIGS. 1-3, therein is shown a modular bullpup configuration rifle 10 according to one embodiment of the present invention. The rifle 10 is fully ambidextrous and includes several modular features that are easily changeable, as will be described later. The illustrated embodiment is operated by a short-stroke, external-piston gas system with downward ejection rearward of the magazine well. As described more fully below, the illustrated embodiment is striker fired, but can be adapted to be hammer fired.

As shown in FIG. 3, the rifle 10 is easily separable into upper and lower assemblies 12, 14 using slide lugs 16 that fit into corresponding notches or slots 18 and are fastened with an interconnecting butt plate 20 using a single assembly pin 22. The upper assembly 12 can include a top accessory rail 24 and/or an adjustable cheek rest 26.

The overall design includes upper and lower assemblies 12, 14 that are readily separable. As shown in FIG. 3, one part includes lugs 16 that are received by and slidably lock into slots 18 in the other parts. In the illustrated embodiment, the lugs 16 are on the upper assembly 12 and the slots 18 in the lower assembly 14. A butt plate 20 engages both the upper and lower parts 12, 14 and is secured with a single takedown pin 22 to prevent the lugs 16 from disengaging from the slots 18.

The upper assembly 12 includes a receiver body 28 and a forward handguard extension 30 attached to it. The length of the handguard extension 30 can be selected to correspond to the barrel length and any muzzle device or attachment. The lower assembly 14 includes a housing 32 with a pistol grip 34 and trigger guard 36. As described later, the lower assembly 14 includes a swappable magazine well module 38 to accommodate different types of detachable magazines 40 and the ejection port 42 can accept swappable accessories.

Referring still to FIGS. 1-3, the gas-operated action includes a short stroke, external piston that engages an operating rod 46 connected to a bolt carrier 44. The bolt carrier can use standard AR-pattern bolts for compatibility with easily accessible aftermarket parts, making it easier to change caliber and for use with military logistics. As shown, the bolt is rotated with the cam pin to the side to eject downward. A recoil and buffer spring means 48 is housed within the upper assembly body 28. The barrel 50 attaches to the upper body 28 with a barrel trunnion 52. The stroke of the action is extended to the rear past the magazine well 38 to provide downward ejection of extracted cases or rounds through the ejection port 42 that is behind the magazine well 38. The increased bolt travel also results in recoil reduction and a lower cyclic rate which help increase accurate fire. The upper assembly 12 includes a forward ambidextrous, non-reciprocating charging handle 54.

A forward part of the lower assembly housing 32 accommodates and positions the trigger blade 56, actuated by the user's trigger finger, and ambidextrous controls for the safety selector 58, magazine release 60, and bolt catch/release 62 adjacent the pistol grip 34. Connection linkages for these controls are separable from the corresponding linkages in the upper assembly 12 or from the magazine well module 38, which includes the operative parts of the magazine release and bolt catch/release. A trigger mechanism module 64, including the manually engaged safety is in the upper assembly 12, though the trigger and safety controls 56, 58 are on the lower assembly 14.

Figure 4C:
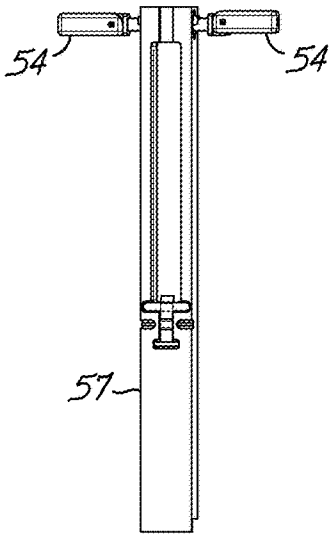
FIG. 4C is a top isometric view of the charging handle.
Figure 4B:
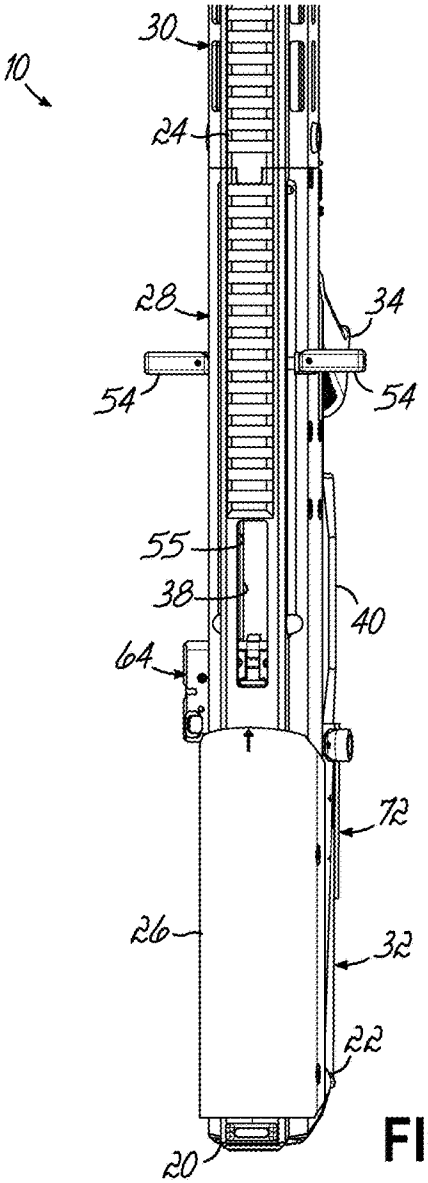
FIG. 4B is a similar view shown the inspection port uncovered by the charging handle in a retracted position.
Figure 4A:
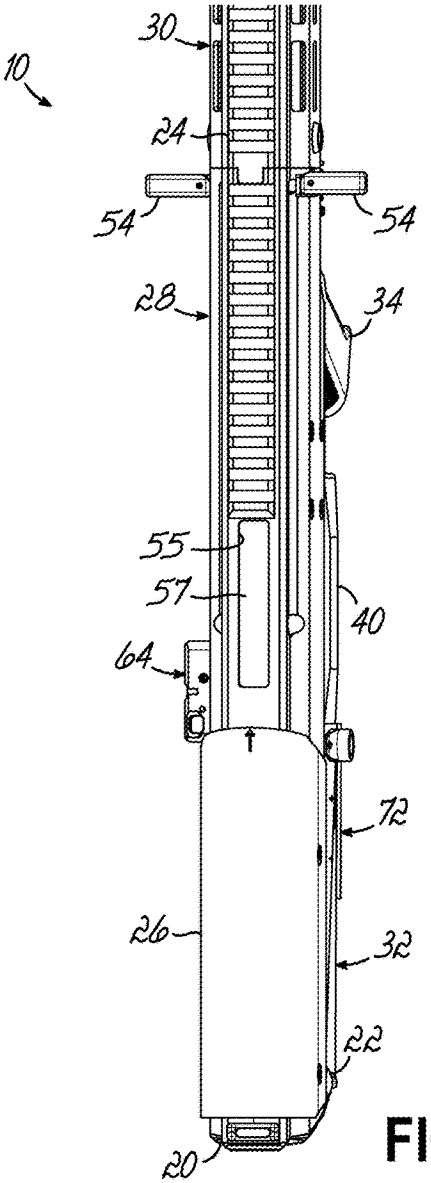
FIG. 4A is a top isometric view of a rifle showing a top inspection port that is covered by the charging handle in the forward position.

Referring now to FIGS. 4A and 4B, therein is shown a top inspection port 55 in the upper assembly body 28. When the charging handle body 57 (shown in isolation in FIG. 4C) is forward, the inspection port 55 is covered by a rear portion of the charging handle body 57, as shown in FIG. 4A. When the charging handle body 57 is retracted and the magazine 40 removed, as shown in FIG. 4B, the inspection port 55 is open and the area inside the upper assembly body 28 above the magazine well 38 and the opening of the barrel chamber can be seen and accessed. Without this feature, cartridge or bolt jams in the illustrated bottom ejecting bullpup style rifle could be very difficult to clear.

Figure 5:
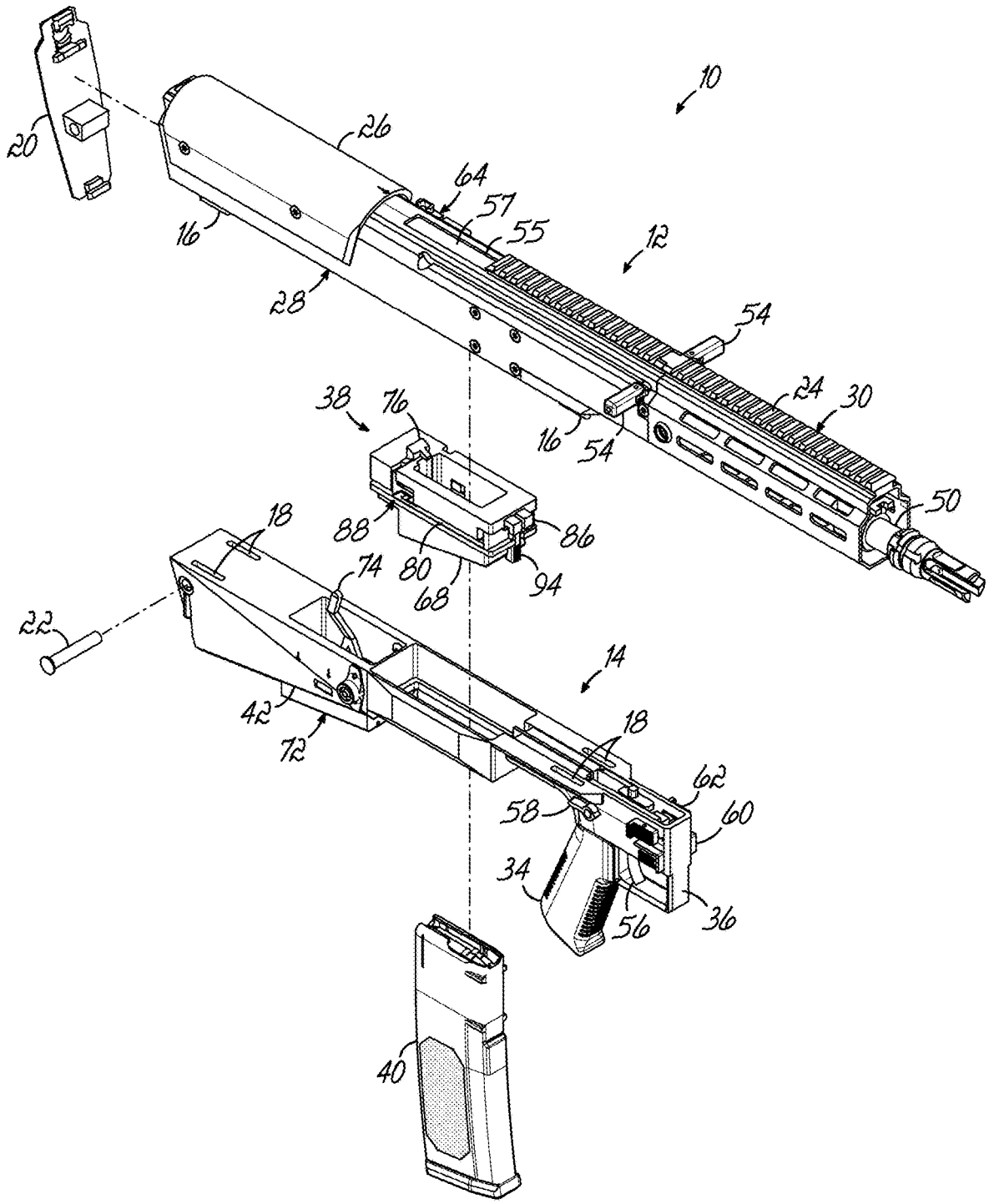
FIG. 5 is another partially disassembled isometric view thereof.

Referring now to FIG. 5, the magazine well module 38 can be removed from the lower assembly body 32 as a unit. Different magazine well modules 38 can accept different types or style of detachable magazines 40 for the same or different caliber ammunition. The operative parts of the magazine release mechanism 66 are selected to correspond to the selected magazine type and are carried by the magazine module body 68. Because the magazine well module 38 is interchangeable as a unit, linkage connections to the magazine release and bolt catch/release to the user actuators in the forward part of the lower assembly body 32 (described in greater detail below) are separable easily, while providing reliable interconnection.

Figure 6:
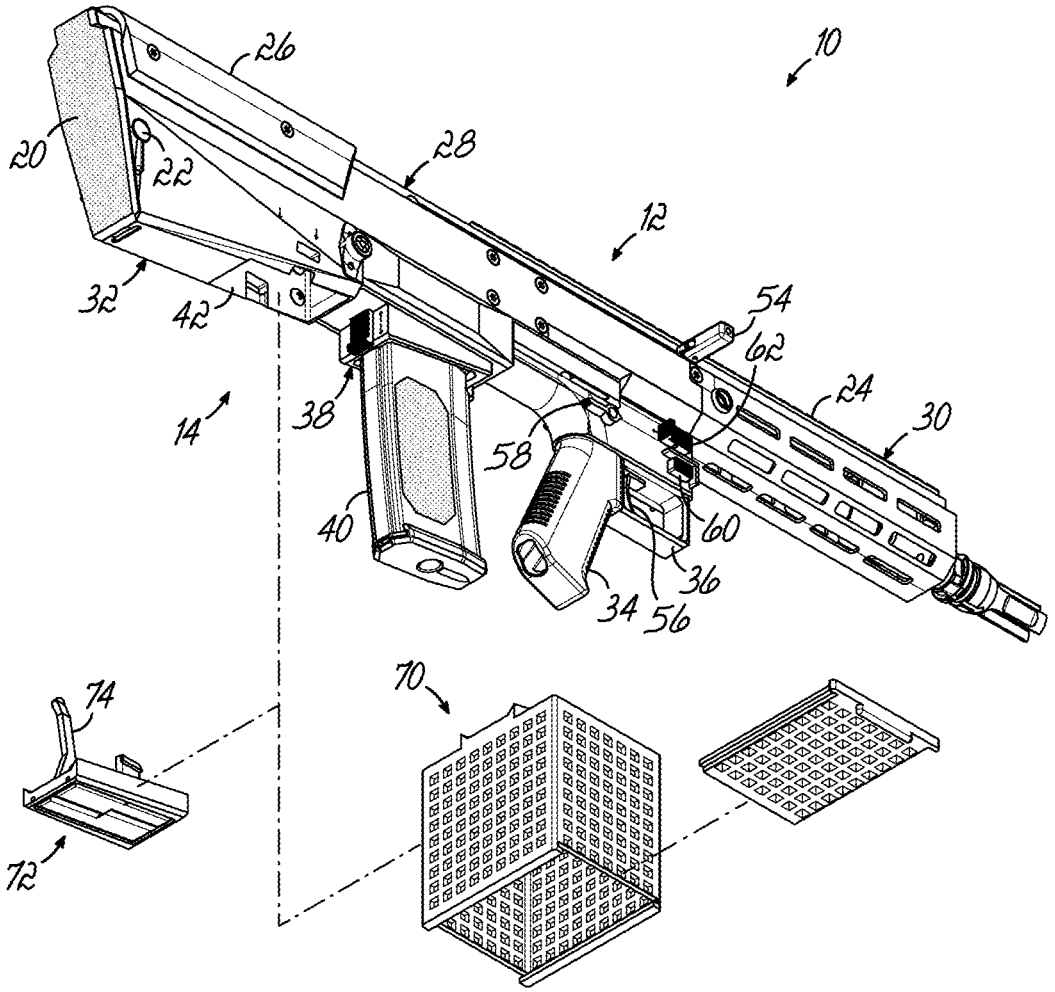
FIG. 6 is an isometric view showing ejection port options.

Referring next to FIG. 6, interchangeable ejection port modules may include a device to catch and collect ejected cases, such as the illustrated rigid box 70 with a sliding or hinged door. Alternately, an automatic door mechanism 72 may be provided. Such a mechanism 72 can include one or multiple cover doors that move together. The mechanism 72 can be operated by, for example, a lever arm 74 that is contacted during the rearward cycle of the bolt carrier 44. Or, if desired, the ejection port 42 can be left open or uncovered.

Referring now to FIGS. 7, 7A, 8, and 9, therein is show the separable magazine release and bolt catch/release mechanisms linkage connections between the magazine module 38 and the operator controls housed in the forward part of the lower assembly body 32 (not shown in these figures). The bolt catch/release member 76 and its operation/controls may be substantially identical for each magazine module 38, but they are carried as a unit with the magazine module 38. The operative parts of the magazine release may vary depending on the type of magazine 40 selected (for example, an AR-pattern or AK-pattern magazine).

Figure 7:
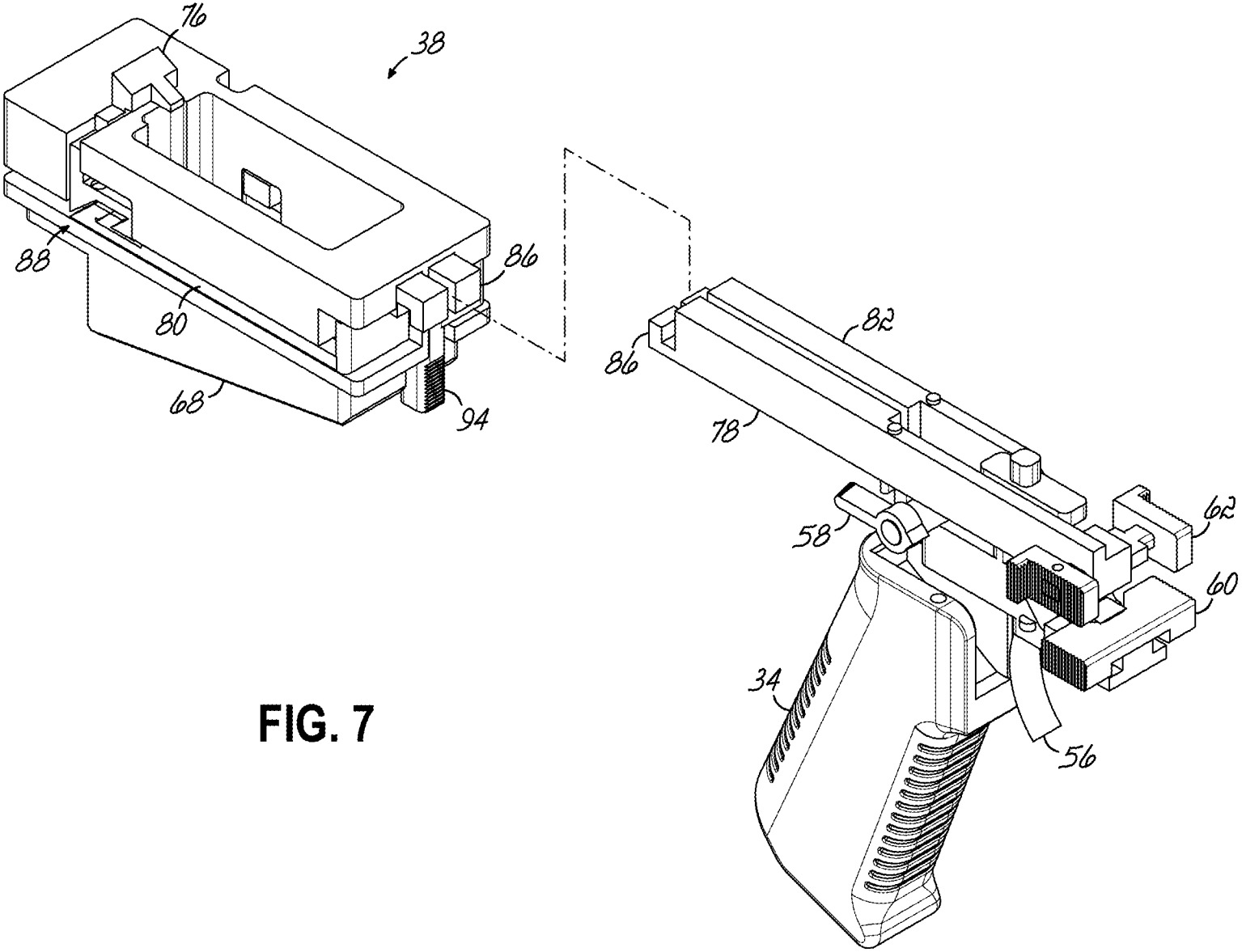
FIG. 7 is an isolated isometric view showing the magazine well module removed from the lower assembly with the bolt catch/release and magazine release controls of the magazine well module linkages disengaged from the control actuators.
Figure 7A:
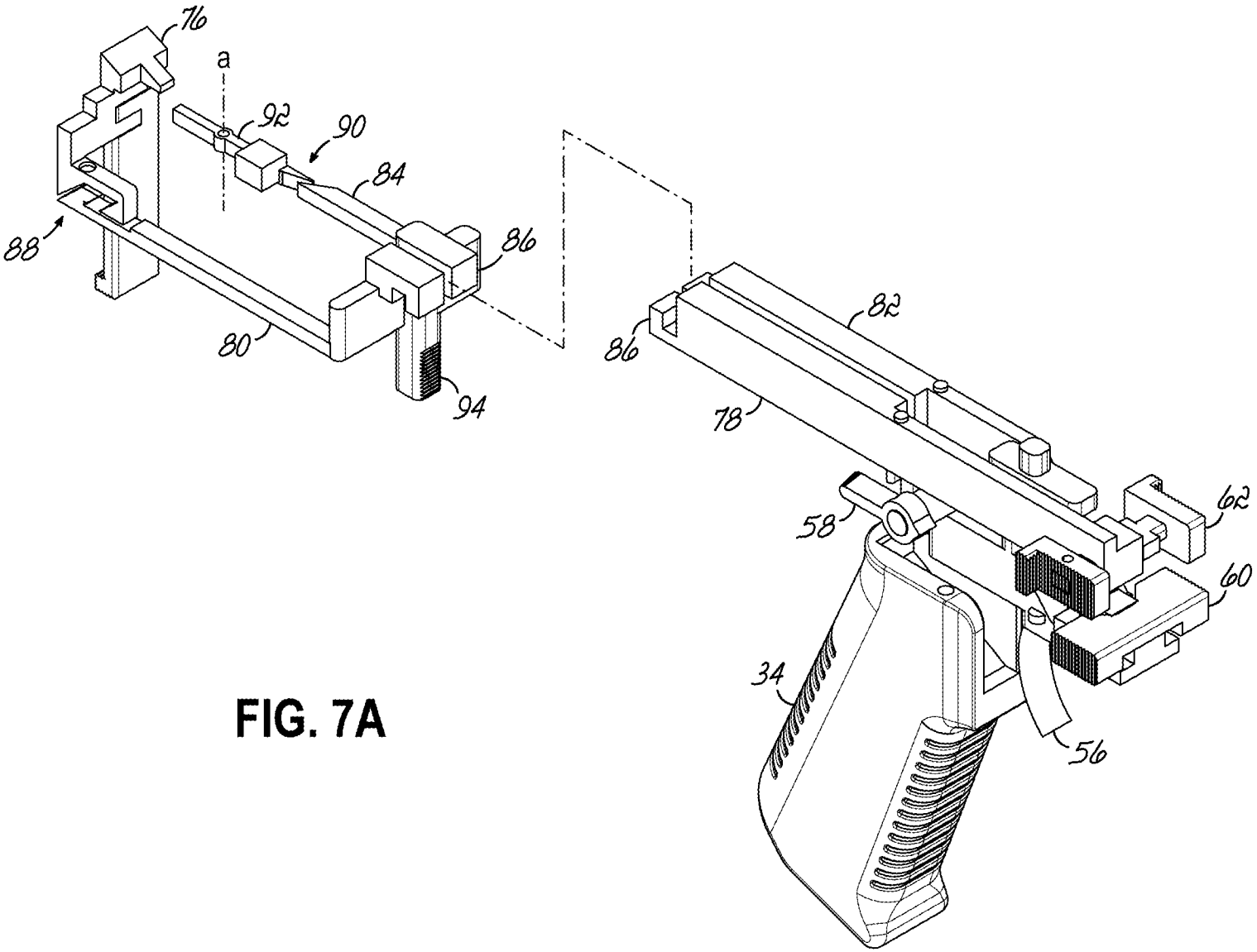
FIG. 7A is a similar view with the magazine well body hidden to reveal internal controls structure.
Figure 8:
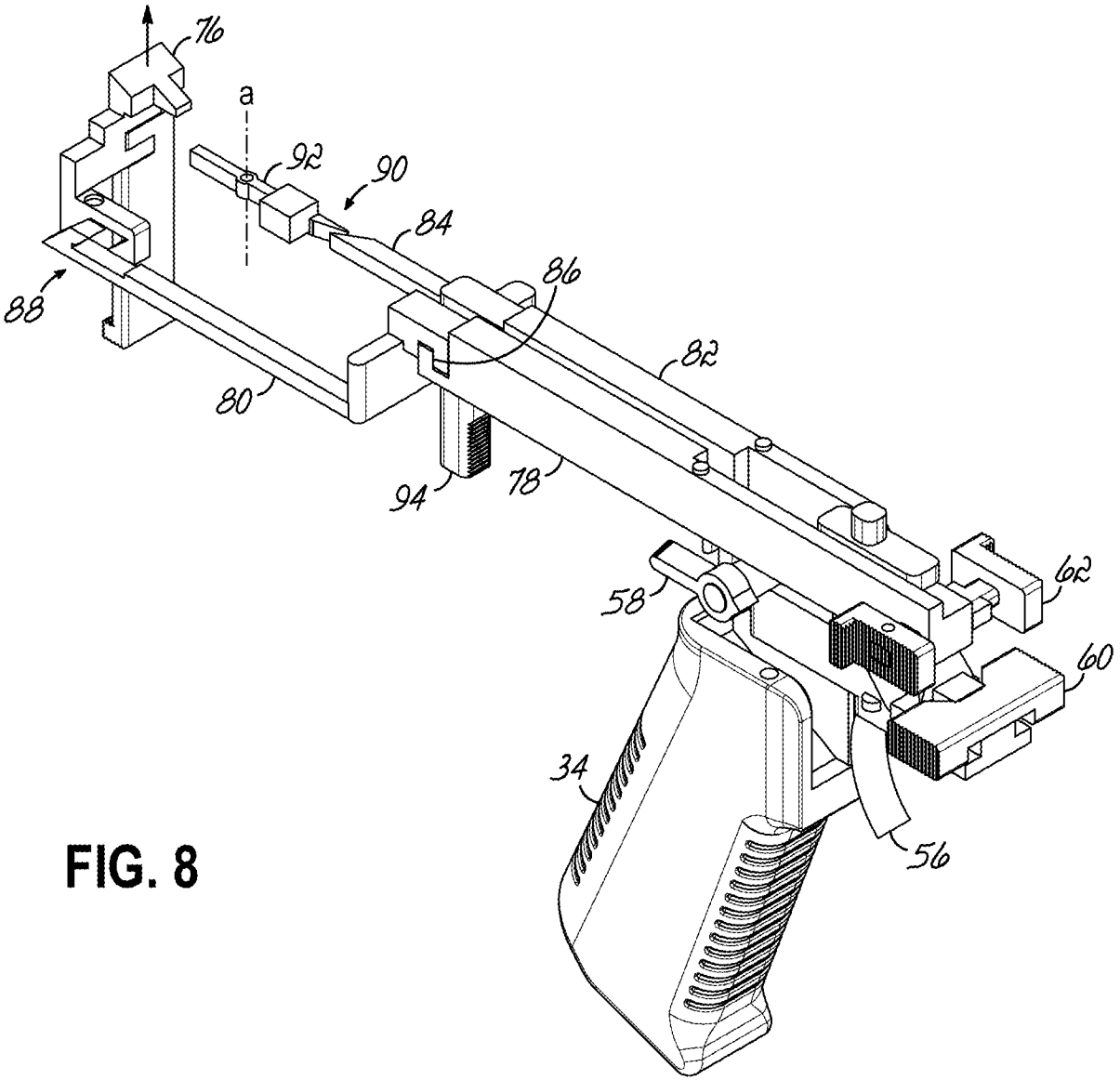
FIG. 8 is a similar view showing the control mechanism linkages connected and the magazine release control actuated.
Figure 9:
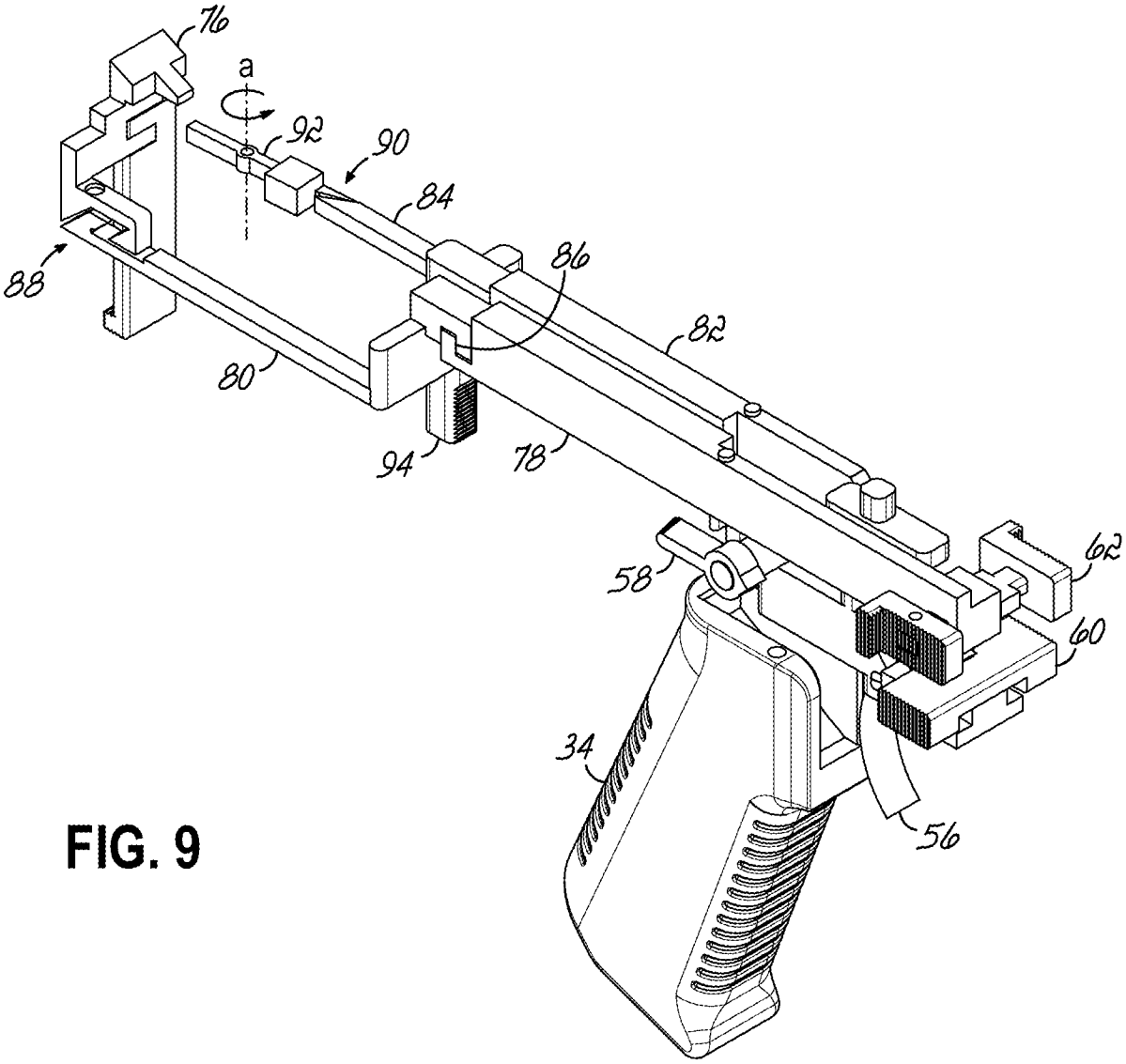
FIG. 9 is a similar view showing the bolt catch control actuated.
Figure 10:
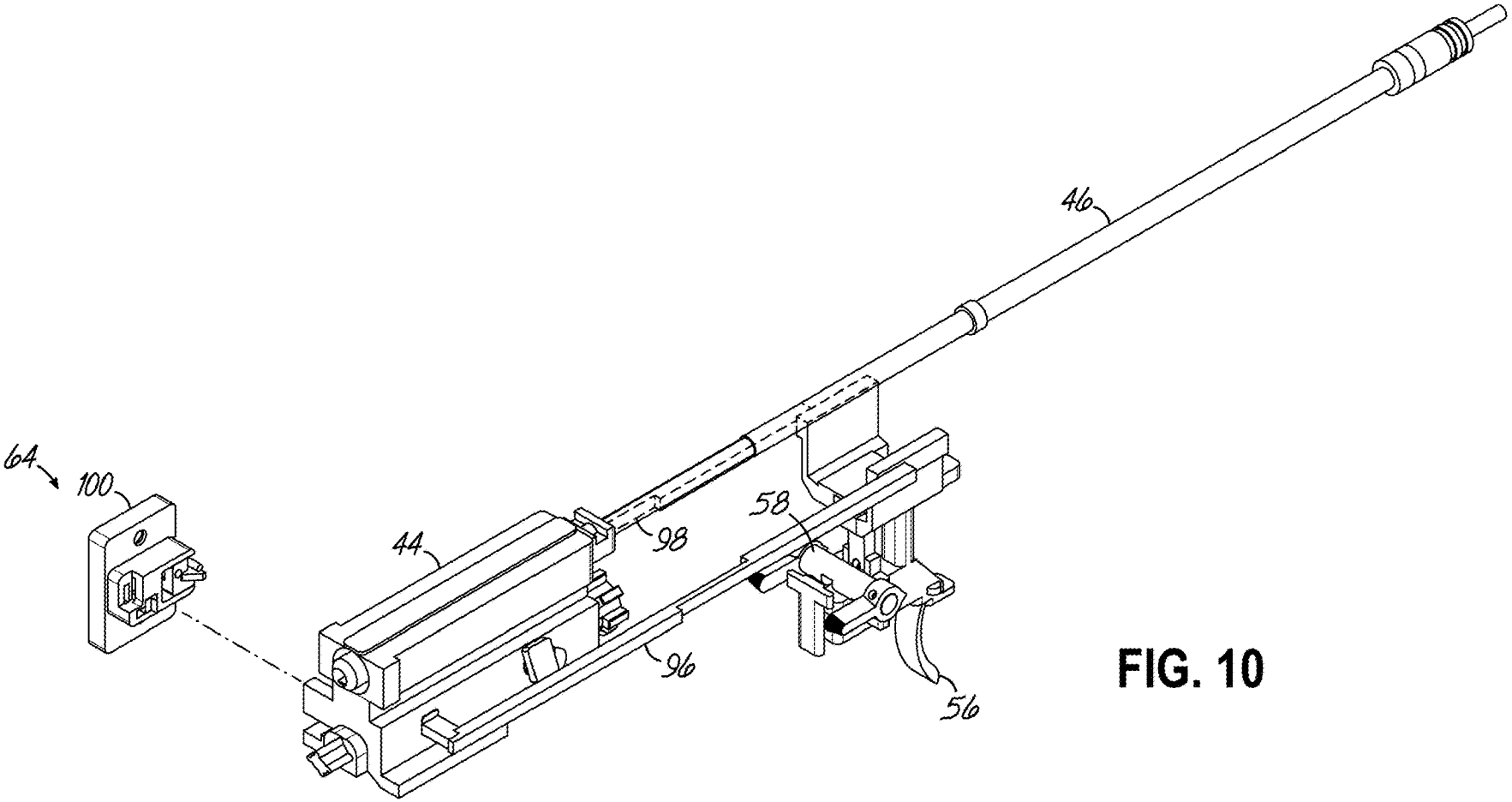
FIG. 10 is a first isolated isometric view showing the trigger and safety controls and linkages of the upper and lower receivers.
Figure 11:
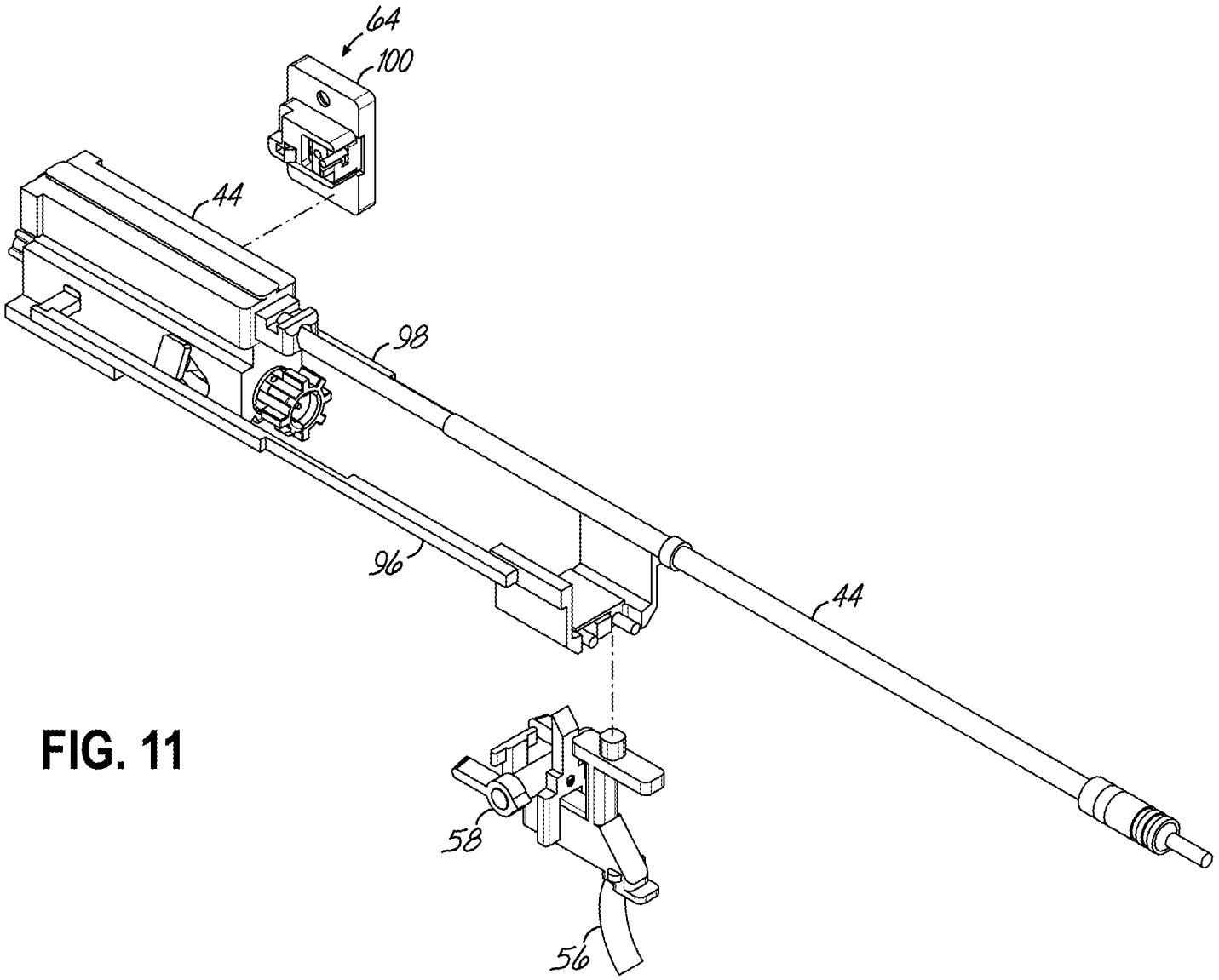
FIG. 11 is a second isometric view thereof.
Figure 12:
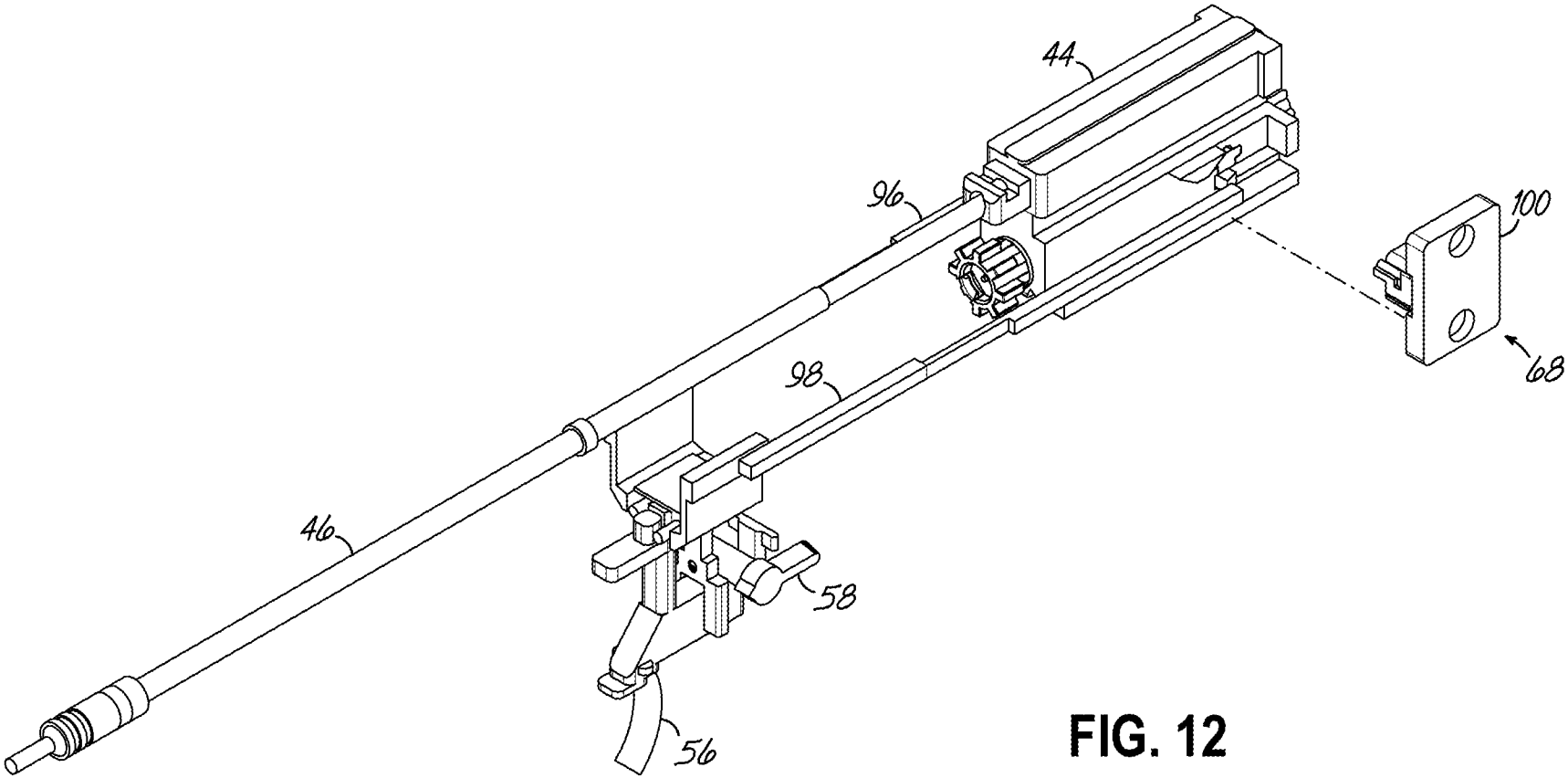
FIG. 12 is a third isometric view thereof.
Figure 13:
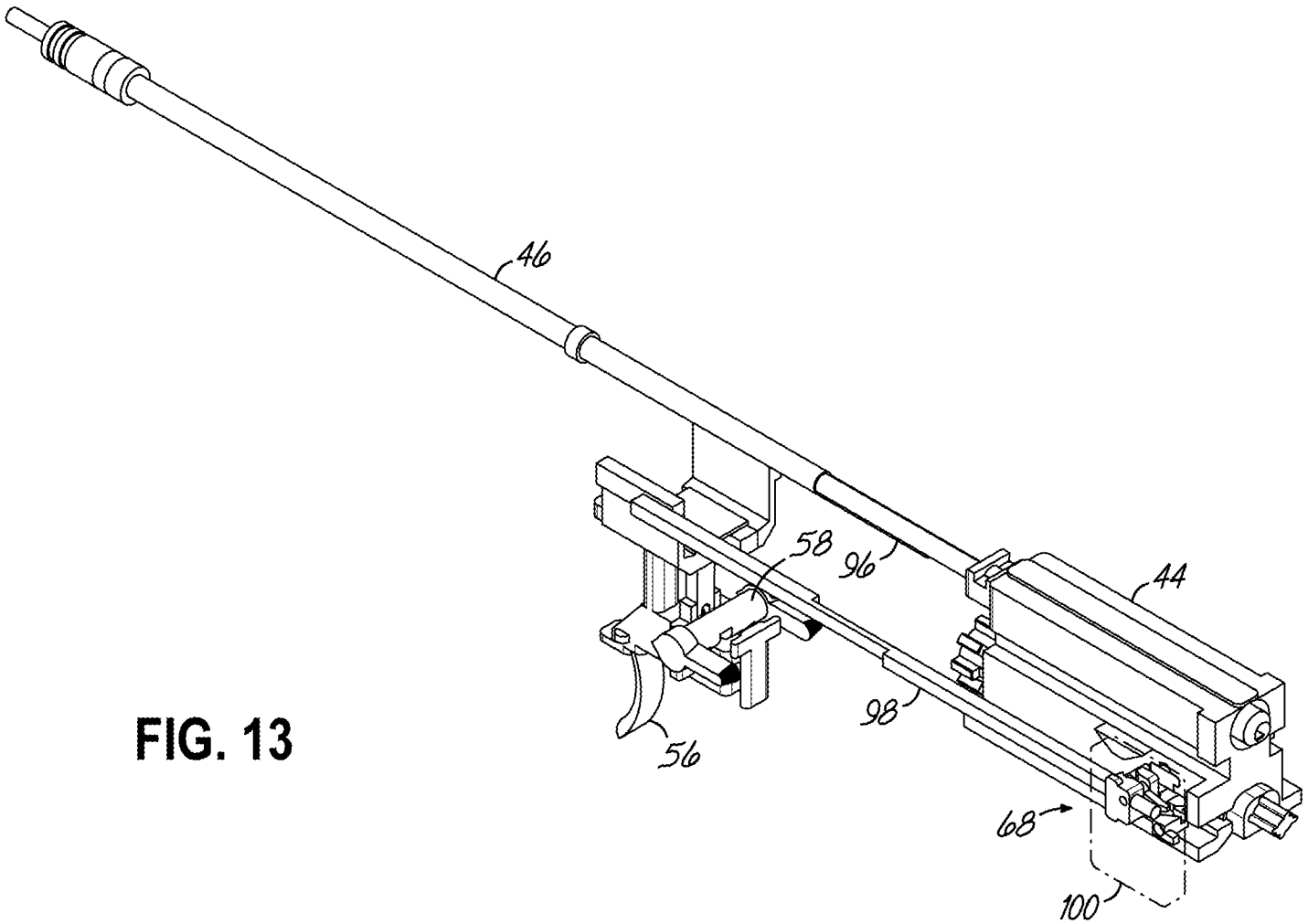
FIG. 13 is a fourth isometric view thereof.
Figure 14:
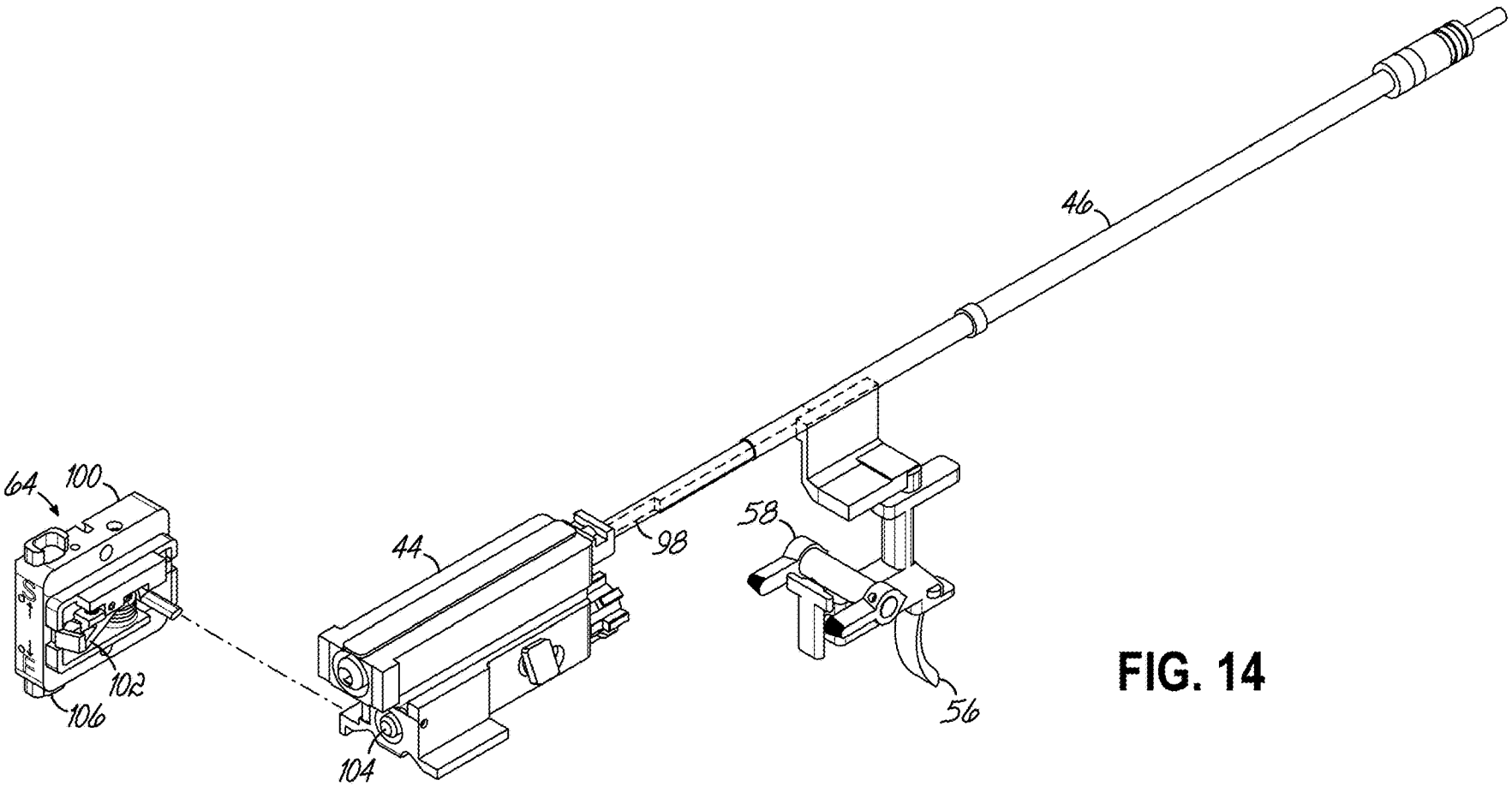
FIG. 14 is a first exploded isometric view of a semiautomatic trigger module, bolt carrier assembly, and trigger actuation mechanism according to another embodiment.
Figure 15:
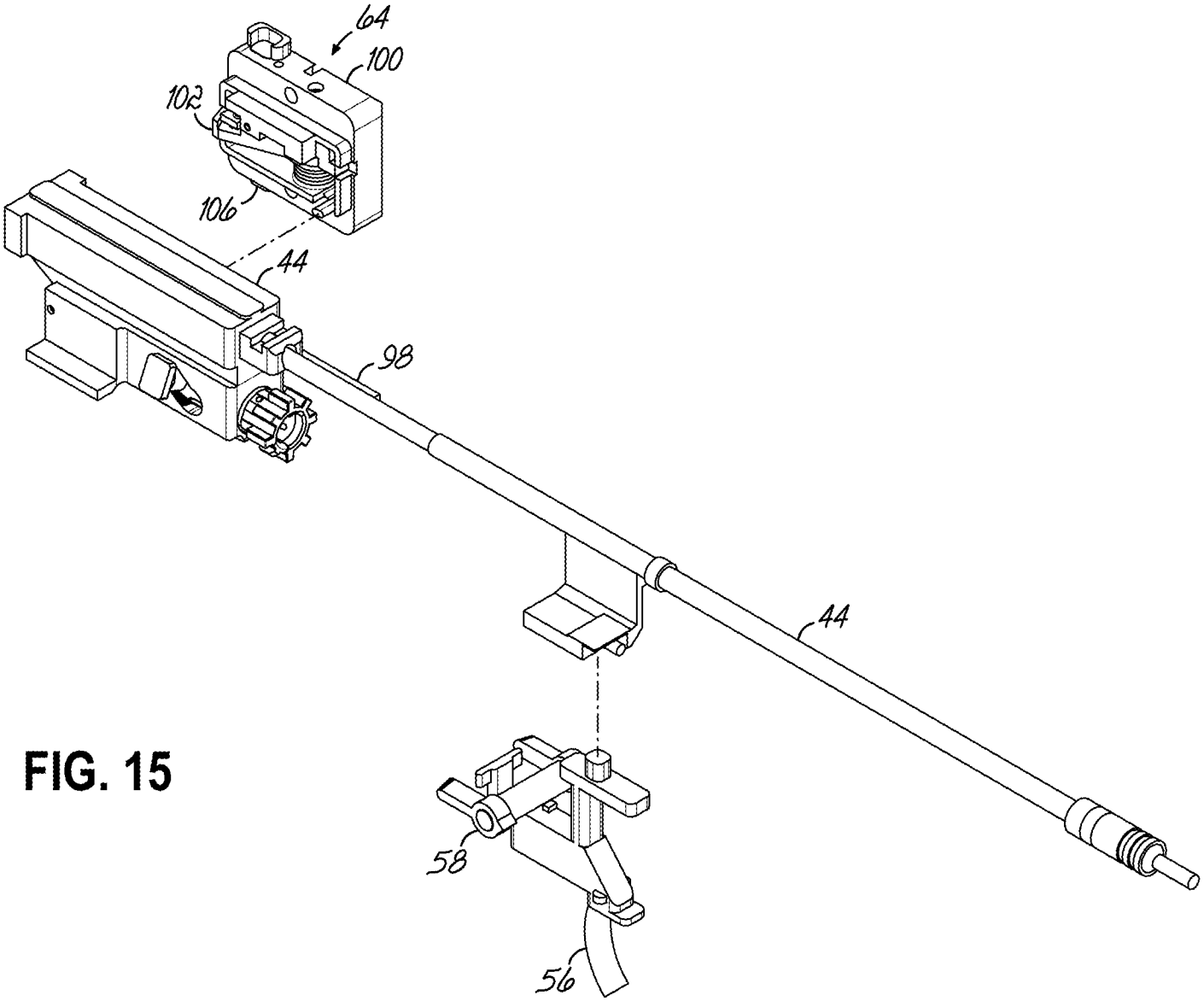
FIG. 15 is a second exploded isometric view thereof.
Figure 16:
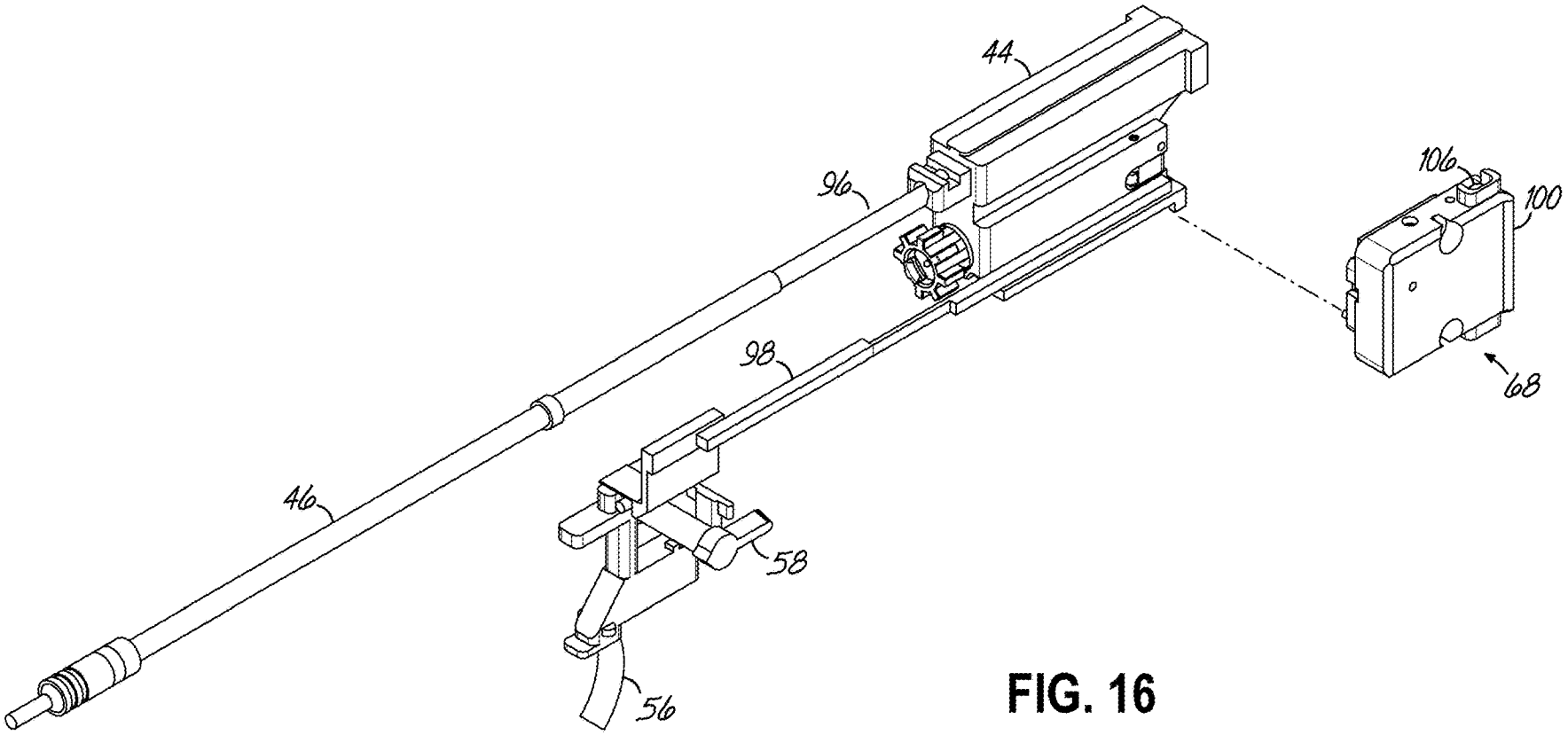
FIG. 16 is a third exploded isometric view thereof.
Figure 17:
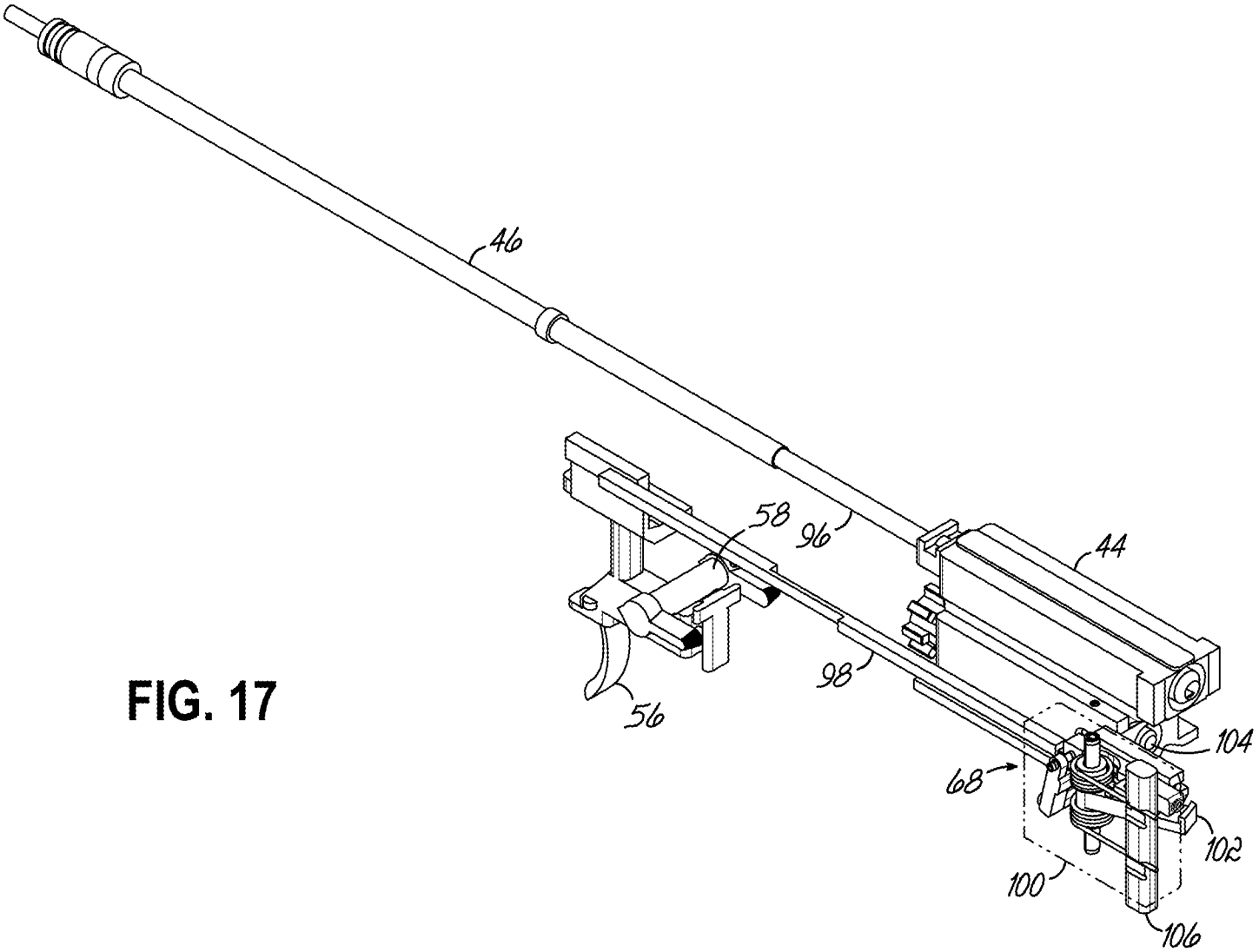
FIG. 17 is a fourth exploded isometric view thereof.

As shown in FIGS. 7 and 7A, both control linkages 78, 79, 80, 82 can connect using mutual hook and socket features 86 that are moved together or apart by relative vertical movement. As illustrated in FIG. 8, when the bolt catch/release control 62 is in a forward position, the angular engagement 88 between the bolt catch member 76 and rear linkage 80 causes the bolt catch 76 to retract/extend (i.e., be moved downward/upward), depending on the direction of force applied. The mechanism may be spring biased to retract as a default position. Moving the control 62 (and linkage) rearward will cause the bolt catch 76 to be lifted, as shown in FIG. 8, to block the bolt/bolt carrier 44 in a rearward position. Likewise, as is well known, the bolt catch 76 can be lifted by contact with a magazine follower when the magazine 40 is empty of ammunition.

Referring again to FIGS. 8 and 9, when the magazine release control 60 is moved rearward (FIG. 8) from its default, at-rest position (FIG. 9), the forward and magazine module linkage 82, 84 is likewise moved, causing cam surfaces 90 to engage and pivot the magazine catch 92 on axis a to release the magazine 40. This mechanism can be spring biased (not shown) toward the default, at-rest position with the magazine catch 92 engaging the magazine 40. A secondary magazine release 94 control, positioned at the front of the magazine well 38 can be provided. This allows the magazine release 94 to be actuated by the user's off hand, if desired, rather than using the trigger hand. This placement is found in other platforms and provides an alternative for a user more familiar with this alternate manual of arms.

Referring now to FIGS. 10-13, therein is shown in isolation the trigger and safety controls and linkages. For these, the longitudinal linkages 96, 98 are in the upper assembly 12 and separability (shown in FIG. 10) is between the upper and lower assemblies 12, 14, rather than mid-linkage, as described above for the magazine release and bolt catch/release.

The safety selector 58 has ambidextrous control levers that pivot in the same manner as a common AR-pattern firearm. Rotation of the safety selector 58 is translated into longitudinal movement of the safety linkage 96 to the bolt carrier 44 that houses the striker or firing pin.

Figure 19:
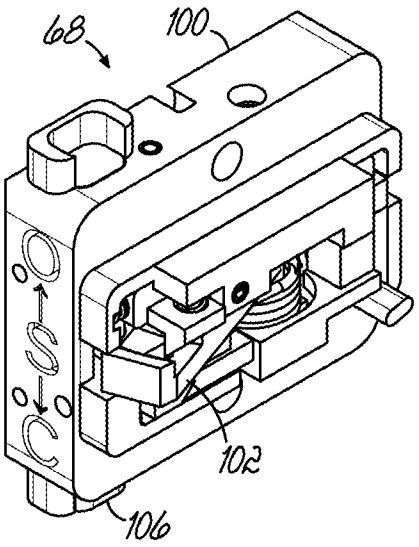
FIG. 19 is an alternate trigger module embodiment that includes a selector that can be moved between safe, semiautomatic, and fully automatic positions.
Figure 18:
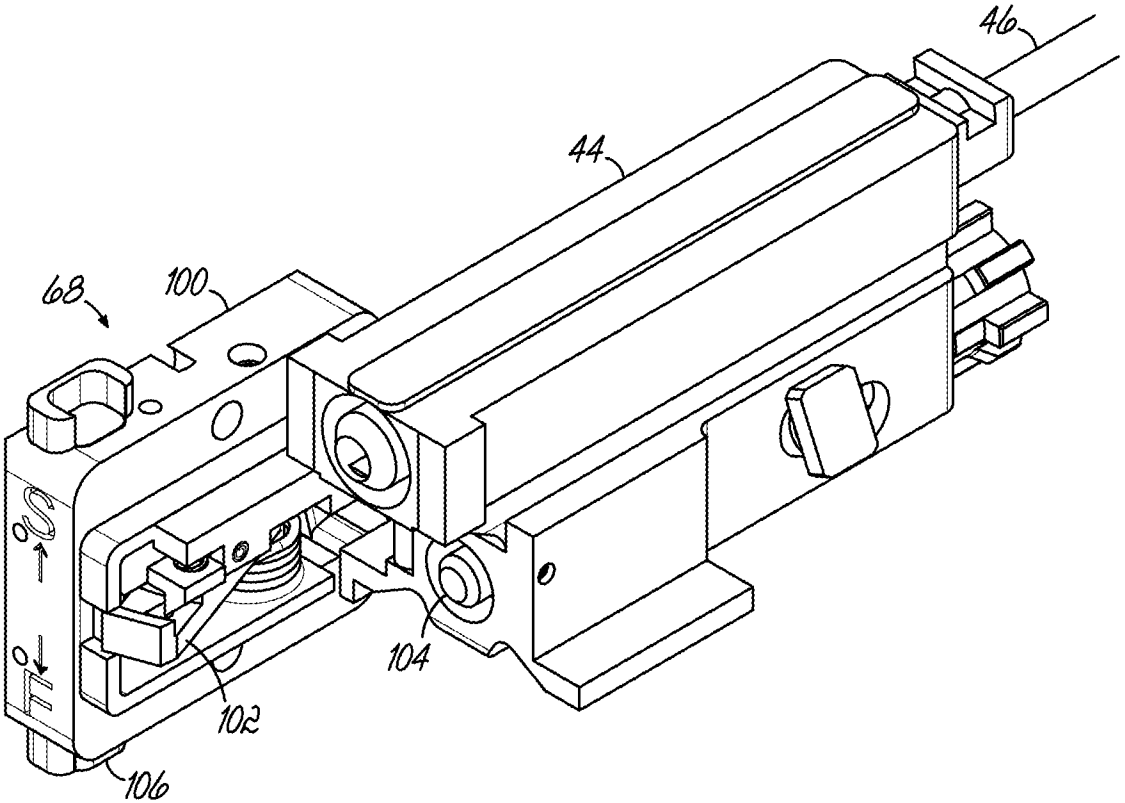
FIG. 18 is an enlarged isometric view showing the trigger module in position with the bolt carrier.

The trigger blade 56, actuated by the user's trigger finger, slides rather than pivots. Sliding motion of the trigger blade 56 longitudinally moves the trigger linkage 98 to release a sear that is in the trigger module 64. The trigger module 64 is carried in a fire control mechanism housing 100 that is secured, for example, to the left side of the upper assembly body 28 (FIG. 1B). The modular nature of the fire control mechanism allows selection of different fire control actions, such as striker versus hammer fired, single-stage verses multi-stage, semiautomatic verses fully automatic, or open versus closed bolt operation. For example, referring first to FIGS. 14-18, the trigger module 64 can be a semiautomatic only mechanism that includes a side-mounted hammer 102 that strikes a firing pin 104 held in the bolt carrier 44. Rearward movement of the trigger linkage 98 causes a sear to release the hammer 102. In this embodiment, a vertical slide-bolt safety selector 106 can be moved manually between safe and fire positions. Referring to FIG. 19, an alternate trigger module 64*a* includes a selector 108 that can be moved between safe, semiautomatic, and fully automatic positions.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A downward ejecting bullpup firearm with a detachable magazine, comprising:

a downward facing ejection port rearward of a magazine well;

a top inspection window positioned substantially in line with the magazine well;

a charging handle body including a rear portion and a forward portion and being movable between forward and rearward positions, the rearward portion blocking the inspection window when the charging handle body is in the forward position and the forward portion including a through-opening that substantially aligns with the inspection window when the charging handle body is in the rearward position.

2. The firearm of claim 1, having separable upper and lower receiver bodies.

3. The firearm of claim 2, wherein the lower receiver body includes an exchangeable magazine well module, the magazine well module including a housing removably connectable to the lower receiver body that is configured to accept a detachable ammunition magazine and carrying a bolt catch member and a magazine catch member.

4. The firearm of claim 3, wherein the bolt catch member and magazine catch member are controlled from a remote position via linkages.

5. The firearms of claim 4, wherein the linkages are separable into first and second parts, the first part being part of the magazine well module and the second part being carried by the lower receiver body.

6. The firearm of claim 5, wherein the first and second linkage parts are detachably connectable upon insertion and removal of the magazine well module for the lower receiver body.

* * * * *